United States Patent [19]

Behar

[11] 4,307,550

[45] Dec. 29, 1981

[54] APPARATUS FOR PRE-STRESSING CONCRETE STRUCTURAL MEMBER

[76] Inventor: Abraham Behar, P.O. Box 848, Catano, P.R. 00632

[21] Appl. No.: 126,008

[22] Filed: Feb. 29, 1980

[51] Int. Cl.[3] ..... E04C 3/10

[52] U.S. Cl. ..... 52/223 L; 24/136 R

[58] Field of Search ..... 52/223 L, 223 R, 230; 24/136 R, 122.6

[56] References Cited

U.S. PATENT DOCUMENTS

| | | | |
|---|---|---|---|
| 3,099,109 | 7/1963 | Hahn | 24/122.6 X |
| 3,422,501 | 1/1969 | Yoshimura | 24/122.6 |
| 3,673,644 | 7/1972 | Howlett et al. | 24/122.6 |
| 3,820,832 | 6/1974 | Brandestini et al. | 52/223 L X |
| 3,956,797 | 5/1976 | Brandestini et al. | 24/126 |
| 4,053,974 | 10/1977 | Howlett et al. | 29/452 |

*Primary Examiner*—Price C. Faw, Jr.
*Assistant Examiner*—Carl D. Friedman
*Attorney, Agent, or Firm*—Scrivener, Clarke, Scrivener and Johnson

[57] ABSTRACT

The disclosure is of apparatus, and the positioning and adjustment thereof within a form in which a pre-tensioned pre-stressed concrete structural member is to be cast, for holding a tensioned strand extending through the concrete against movement after release of the tensioning force, thereby to prevent the formation in the cast body of the weakened zone known as the "development length."

5 Claims, 5 Drawing Figures

APPARATUS FOR PRE-STRESSING CONCRETE STRUCTURAL MEMBER

BACKGROUND OF THE INVENTION

In the manufacture of pre-tensioned, pre-stressed concrete structural members it is conventional to provide wedge means external to the piece to be cast for holding the tensioned steel from movement after the tensioning apparatus is removed from the strand, which may be a wire, cable, rod or the like and which is referred to hereinafter, as in the industry, by the term "the steel."

The release of tension on the steel causes two phenomena to occur, the first being that the embedded steel tends to expand in diameter, and the other being that the steel tends to move into the cast concrete in a direction longitudinal to the steel. These effects result in weakening of the concrete in a zone surrounding the strand and extending inwardly from the external surface of the cast member for a distance which may be a large multiple of the diameter of the steel. This weakened zone is known in the industry as the "development length."

In FIG. 1 of the drawings there is shown, for purpose of illustration of the prior art, the conventional assembly of parts used in the manufacture of pre-tensioned, pre-stressed pre-cast concrete structural members. Such an assembly includes a form 2 within which the concrete member is cast, and which is closed by end plates 4, each of which is provided with one or more openings 6 leading to the interior of the form. A tensioned steel strand 8 is passed through the openings 6 and through the form and protrudes from the plate at each end of the form. Outside each end of the form there is provided means for holding the tensioned steel, and each such means comprises a wedge assembly including barrel 10 which rests on a fixed buttress 11 and has an internal frusto-conical surface 12 on which a plurality of wedges 14 are positioned in surrounding relation to the steel 8. A tensioning force in the direction of the arrow of FIG. 1 is applied to the steel, the concrete is cast within the form, and after the concrete is fully set the tensioning force is released and the wedge assemblies are removed. The purpose of the wedge assemblies to prevent retraction of the steel into the cast body of concrete, but it has been found that when the tensioning force is released the steel tends to enlarge in diameter and to retract into the cast body, and these effects cause a weakening of the cast body in a zone extending from the inner surface of each end plate inwardly of the cast body for a distance that may be as much as 100 times the diameter of the steel. This zone is known in the industry as the "development length" and is so designated in FIG. 1.

It is usually desirable or necessary to attach an end plate to the cast structural member, and because of the existence of the development length zone additional means must be provided for securing such an end plate to the structural member. This is conventionally done by welding one or more elongated rods 20 to the inner surface of the end plate, each rod having a length greater than the depth of the development length zone, as shown in FIG. 1. The attachement of this reinforcing and connecting rod may be effected by welding or other suitable means before the form is closed and the casting begins.

It has been the object of this invention to provide apparatus by which the development length zone is prevented in the manufacture of concrete structural members such as beams, columns, piles and the like. The elimination of the development length zone has important advantages which may not be immediately apparent. For example, it is often desirable and necessary to connect two such structural members in end-to-end relation, and in order to do this it is necessary to secure end plates to the structural members. In following known procedures in the manufacture of such pre-stressed members the formation of the development length zone at the end of the member prevents secure attachment of an end plate to the member without the use of additional attachment means, while utilization of the present invention results in attachment of each end plate to the cast body by the tensioned steel itself without the necessity of any additional connecting means. Further, the formation of the development length zone following conventional procedures and using known apparatus results in the weakening of the end parts of the structural member, thereby requiring special techniques in building and other structures, such as the use of special reinforcing rods within the development length zone. This is entirely obviated by the use of the present invention, as with such use the zone is eliminated.

SUMMARY OF THE INVENTION

The invention provides, in combination with a pre-cast, pre-tensioned, pre-stressed concrete structural member, an end plate in surface-to-surface engagement with the concrete member through which the tensioning steel passes into and through the cast member, and wedge means internally of the plate and engaging it and surrounding the tensioning steel and positioned to resist expansion of the steel and retraction of the steel into the cast body when the tensioning force on the steel is released.

DESCRIPTION OF THE INVENTION

Figure 1:
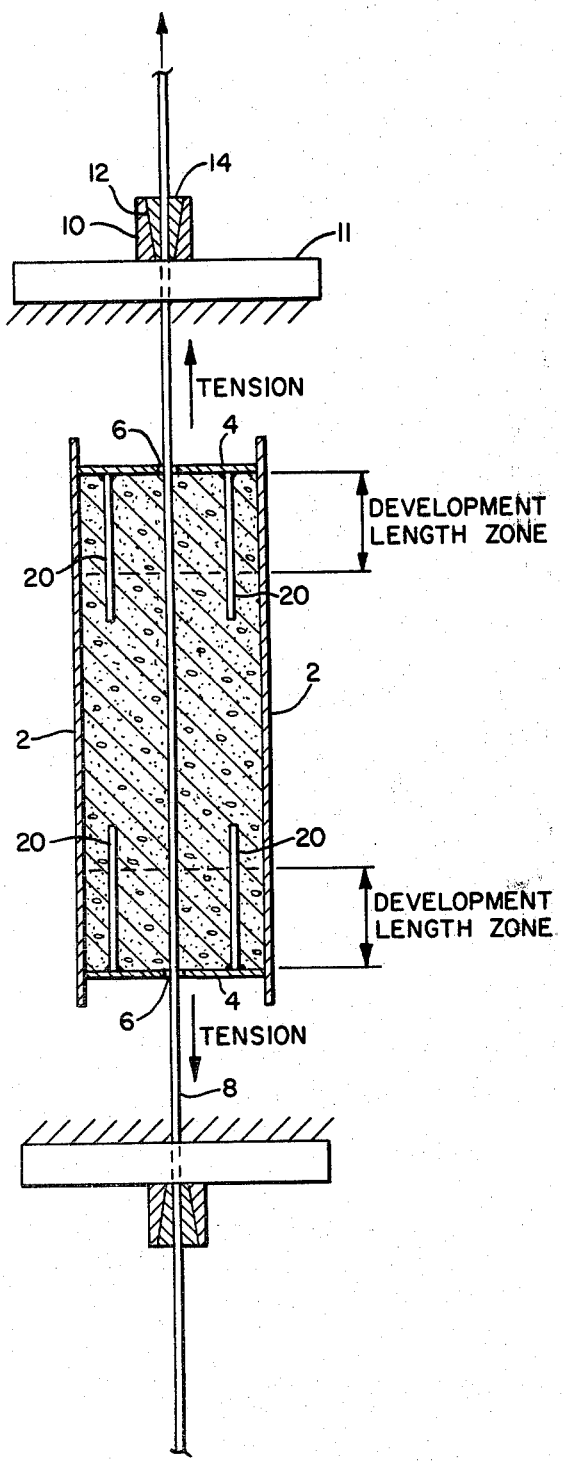
FIG. 1. (PRIOR ART)
FIG. 1 is a schematic view showing the conventional means used in forming a pre-cast, pre-tensioned, pre-stressed concrete member and illustrating the development length zone resulting from the use of such conventional means.
Figure 2:
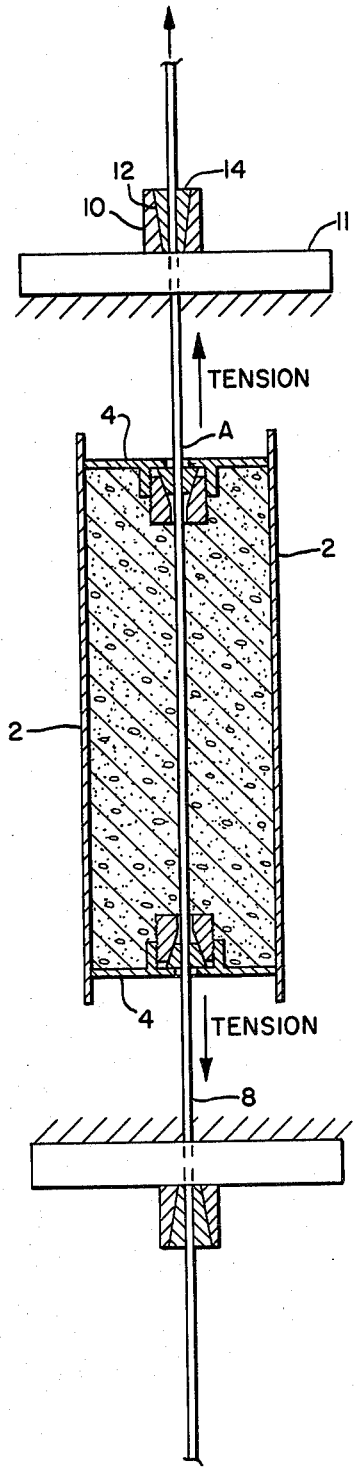
FIG. 2 is a view which is similar to FIG. 1 but shows the addition of the means provided by this invention.

FIG. 2 of the drawings discloses the casting and pre-stressing assembly of parts shown in FIG. 1 together with the means added by the present invention and omitting, of course, the reinforcing rods 20 and the indication of the development length zones, both of which are obviated by the present invention. As shown in this figure the means provided by the invention are located internally of the end plate 4 and in surrounding relation to the steel 8, and one of such means is illustrated in enlarged detail in FIG. 3 and is described in detail as follows.

In accordance with the invention the inner surface of the end plate 4 has integrally formed thereon a cylindrical flange 30 which extends inwardly of the form 2 from the inner surface of the plate and which is positioned concentrically with an opening 6 in the end plate through which the steel 8 extends, it being understood that any number of such openings and surrounding flanges may be formed in the end plate at each end of the form. The flange 30 is threaded, as shown, for threaded connection to a cylindrical barrel 34 which is provided with a central opening therethrough which adjacent the end plate 4 has a frusto-conical surface 36 with its larger end adjacent the end plate. Within the central opening in the barrel there are provided a plurality of wedge members 40 which are positioned in circular arrangement surrounding and in close engagement with the steel 8 and with their outer surfaces in engagement with the frusto-conical surface 36 of the barrel, the larger ends of the wedges being adjacent the plate 4.

Figure 3:
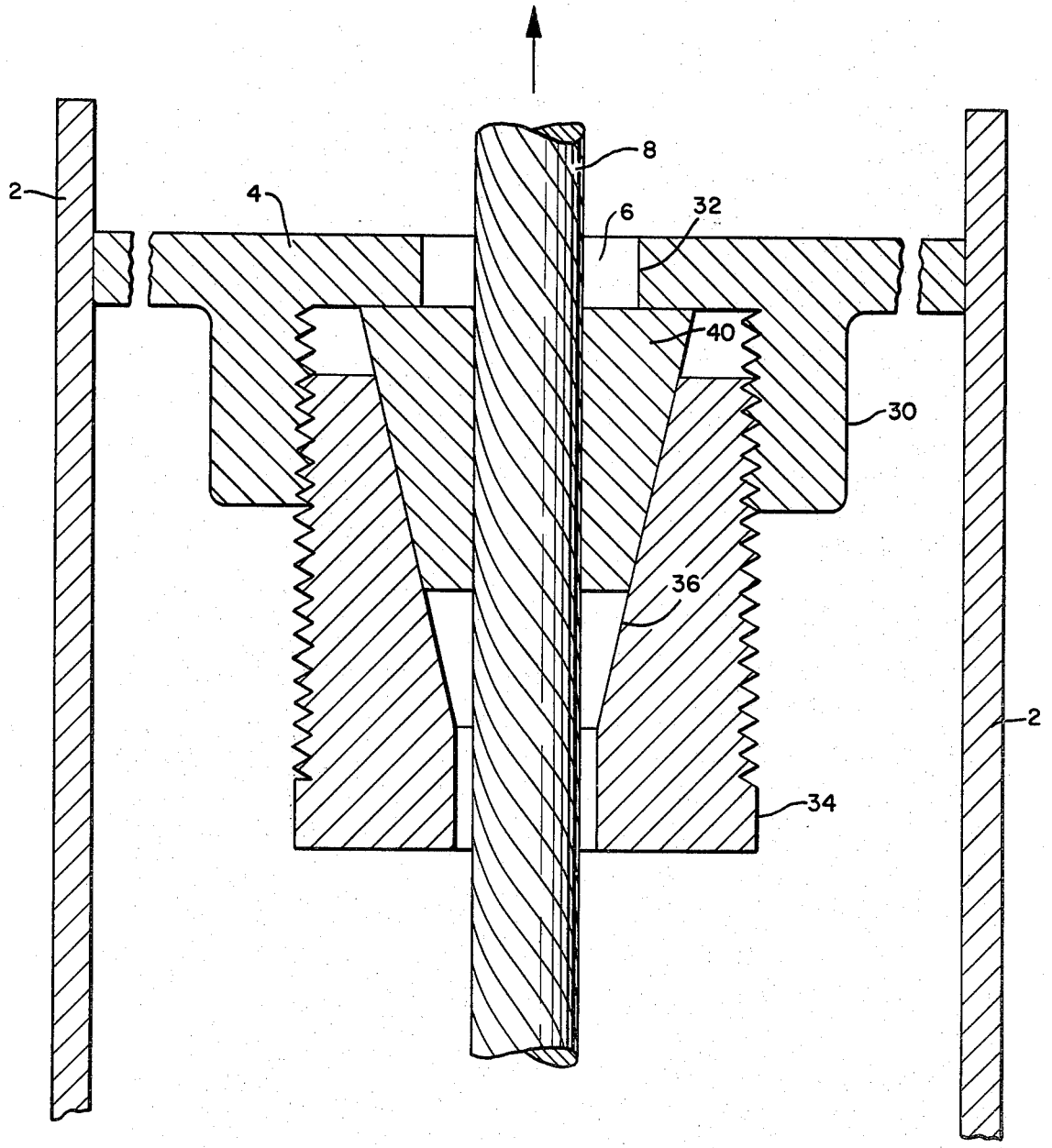
FIG. 3 is an enlarged sectional view showing one end of a cast concrete structural member and disclosing also the means porovided by the invention for holding the tensioned steel.

In the use and operation of the described apparatus in the formation of a pre-tensioned, pre-stressed, pre-cast concrete structural member all of the parts illustrated in FIGS. 2 and 3 are assembled as shown in the two figures, the barrel 34 loosely surrounding the steel 8 within the form. Tension is now applied to the steel and the wedge and other steel holding means 10, 11, 12, 14 external to the form provide their usual function. At this point the wedge means 40 are assembled within the barrel 34 as shown in FIGS. 2 and 3 and the barrel is threaded onto the flange 30 causing the wedges 40 to move toward the plate 4, and this operation will continue until the outer, larger ends of the wedges are in engagement with the inner surface of the plate. Concrete is now poured within the form 2 and allow to set.

The tension on the steel 8 is now released, for example by cutting the steel external to the form. The effect of this on the steel is to cause the steel to tend to expand transversely of its length and to tend to move into the cast body with the adverse results described above, including the formation of the development length zone, but the apparatus provided by the invention prevents these adverse results. The enlargement of the steel cannot take place because of the interposition of the fixed, rigid assembly of wedges and barrel between the steel and the plate, and movement of the steel into the cast body is prevented by the gripping pressure of the wedges on the steel. As there is no movement of the steel into the cast body there is no formation of a development length zone. Furthermore, the end plate is firmly attached to the cast body through the flange, barrel, wedges and strand, thus requiring no additional connecting means between the plate and the cast body such as the rods of FIG. 1.

In the embodiment of the invention disclosed in FIGS. 2 and 3 the assembly of barrel and wedges is connected to the end plate by a threaded connection between the barrel and a flange formed integrally with the end plate extending into the form, and the wedges are moved into operative position against the inner surface of the end plate by moving the barrel with respect to the flange. Other forms of operative relation of the wedges to the end plate are within the scope of the invention and examples of these are disclosed in FIGS. 4 and 5.

In the embodiment disclosed in FIG. 4 an internally threaded opening 50 is provided in end plate 4, and within this opening and in the general plane of the plate there is threaded a cylindrical plug 52 which has a central un-threaded opening through which the steel 8 passes into the cast body and which extends within the body below the inner surface of the end plate, thus forming an interior abutment surrounding the steel 8. A barrel 54 is internally threaded at its upper end for adjustable attachment to the external threads of the plug 52, and below these threads, or internally of the form, the barrel is provided with an internal frusto-conical surface 56 which is concentric with the steel 8 and plug 52 and has its larger end adjacent the inner end of the plug. A plurality of wedge segments 58 are provided within the barrel and have external surfaces corresponding to the internal frusto-conical surface of the barrel.

Figure 5:
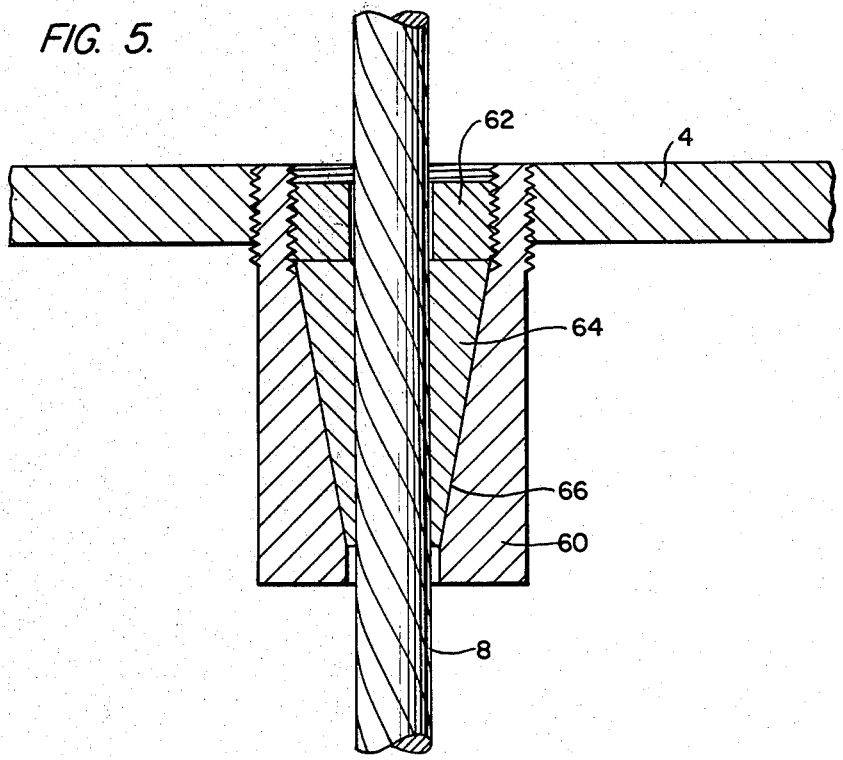

In the embodiment of the invention disclosed in FIG. 5 the upper end of the barrel 60 is externally threaded for adjustable connection within an internally threaded opening 62 in plate 4, and is also internally threaded to receive an externally threaded plug 62 which has a central opening through which the steel 8 passes. The assembly of wedges 64 surrounds the steel 8 within the barrel and co-operates with the frusto-conical surface 66 of the barrel in the same manner as in other forms of the invention.

Figure 4:
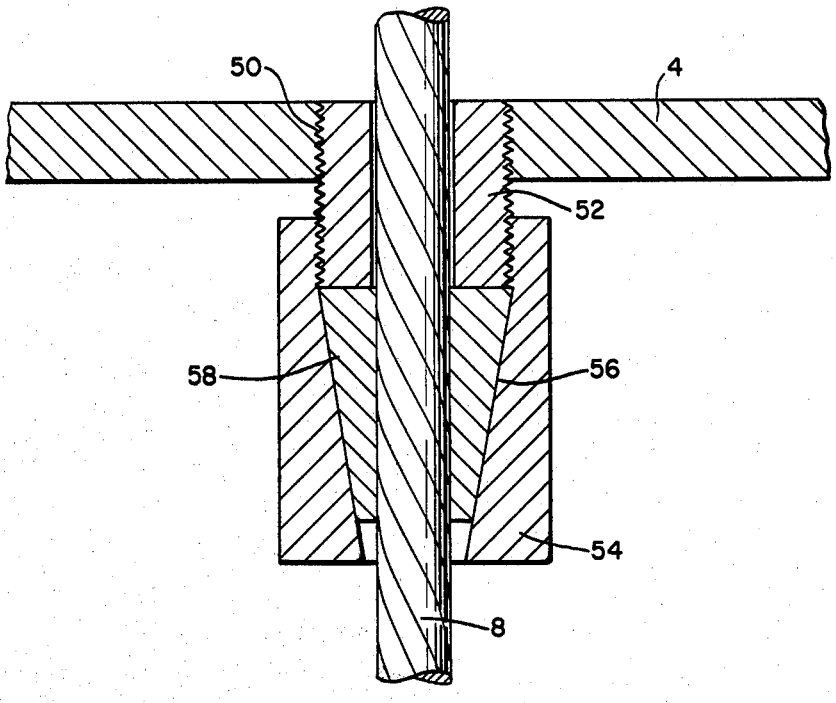
FIGS. 4 and 5 are views which are similar to FIG. 3 and show two further embodiments of the invention.

It is important to note that in all forms of the invention, the wedges cannot become loose after the parts are adjusted prior to pouring concrete, because the barrel and wedges are moved toward the end plate until the large ends of the wedges abut a fixed part, which is the end plate in the embodiment of FIGS. 2 and 3, the plug 52 of FIG. 4, or the plug 62 of FIG. 5. Thus, after such adjustment the end plate, barrel and wedges form a fixed, rigid assembly which prevents expansion of the steel and retraction of the steel into the cast concrete after release of the external means which applies tension to the steel.

I claim:

1. A pre-tensioned, pre-stressed, pre-cast concrete structural member comprising a body of cast concrete having at least one surface, a plate in surface-to-surface engagement with the surface, a tensioned steel extending through the plate and into the body, and means within the body connected to the plate and operable to resist transverse expansion of the steel and movement of the steel longitudinally into the concrete body, said means comprising wedge means at least partially surrounding and engaging the steel, and means for adjustably connecting the wedge means to the plate.

2. The structural assembly according to claim 1, in which the last named means comprises a barrel having a frusto-conical interior surface engaging the corresponding surface of the wedge means, and an adjustable connection between the barrel and the plate.

3. The structural assembly according to claim 1, in which the means within the concrete body comprises an annular flange integrally formed with the plate and extending inwardly therefrom into the cast body in surrounding relation to the steel and being internally threaded, an externally threaded barrel threadedly connected to the flange within the cast body and having an internal frusto-conical surface with its large end adjacent the plate, and wedge means within the barrel in surrounding relation to the steel and having its wedge surface engaging the corresponding surface of the barrel.

4. The structural assembly according to claim 1, in which the means within the cast body comrpises a threaded opening in the plate, a cylindrical plug externally screw threaded into the opening and having a central opening through which the steel extends, a barrel having internal screw threads at one end threaded to the plug and having a frusto-conical internal surface concentric with the plug and extending in the direction internally of the cast body from the plug, and wedge means within the barrel in surrounding relation to the steel and having its wedge surface engaging the corresponding sruface of the barrel.

5. The structural assembly according to claim 1, in which the means within the cast body comrpises a threaded opening in the plate through which the steel extends, a barrel surrounding the steel and having internal and external screw threads at its one end and being connected within the plate opening by its external thread, an annular plug threaded into the end of the barrel and positioned generally in the plane of the plate and surrounding the steel, the barrel having a frusto-conical internal surface concentric with the plug and extending in the direction internally of the cast body from the plug, with its largest surface adjacent the plate and the plug, and wedge means within the barrel in surrounding relation to the steel and having its wedge surface engaging the corresponding surface of the barrel and its largest end engaging the plug when the parts are in operative positions and relations.

* * * * *